US009343051B2

(12) United States Patent
Uehara

(10) Patent No.: US 9,343,051 B2
(45) Date of Patent: May 17, 2016

(54) PERFORMANCE INFORMATION OUTPUT CONTROL APPARATUS, KEYBOARD INSTRUMENT AND CONTROL METHOD THEREOF

(71) Applicant: YAMAHA CORPORATION, Hamamatsu-shi, Shizuoka (JP)

(72) Inventor: Haruki Uehara, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 14/742,174

(22) Filed: Jun. 17, 2015

(65) Prior Publication Data

US 2015/0371619 A1 Dec. 24, 2015

(30) Foreign Application Priority Data

Jun. 20, 2014 (JP) ..... 2014-127458

(51) Int. Cl.
*G10H 1/18* (2006.01)
*G10H 1/00* (2006.01)

(52) U.S. Cl.
CPC ..... *G10H 1/18* (2013.01); *G10H 1/0066* (2013.01)

(58) Field of Classification Search
USPC ..... 84/615
IPC ..... G10H 1/18
See application file for complete search history.

(56) References Cited

U.S. PATENT DOCUMENTS 5,386,083 A * 1/1995 Kawamura ..... G10C 5/005 84/171
5,463,184 A * 10/1995 Kawamura ..... G10C 5/005 84/171
5,612,502 A * 3/1997 Ura ..... G10H 1/344 84/171
5,679,914 A * 10/1997 Niitsuma ..... G10H 1/346 84/21
5,731,530 A * 3/1998 Fujiwara ..... G10F 1/02 84/115
5,739,450 A * 4/1998 Fujiwara ..... G10G 3/04 84/20

(Continued)

FOREIGN PATENT DOCUMENTS

JP 2003005754 A 1/2003
JP 2008175969 A 7/2008
JP 2009116325 A 5/2009

*Primary Examiner* — David Warren
(74) *Attorney, Agent, or Firm* — Rossi, Kimms & McDowell LLP

(57) ABSTRACT

A performance information output control apparatus includes a detection part which detects a plurality of positions of a music performance interface during a single stroke with respect to an operator of a keyboard instrument, the music performance interface including a mechanism that interlocks with the operator, an estimated music-sound generation time analysis part which calculates an estimated music-sound generation time point representing a time point at which music sound according to the single stroke with respect to the operator is estimated to be generated, based on a detection result of the positions of the music performance interface by the detection part, and a music performance information output part which outputs, when the detection result by the detection part is obtained, music performance information representing music performance contents corresponding to the single stroke with respect to the operator prior to the calculated estimated music-sound generation time point.

8 Claims, 6 Drawing Sheets

(56) References Cited

U.S. PATENT DOCUMENTS 6,075,196 A * 6/2000 Fujiwara ..... G10H 1/344 84/13
2001/0003945 A1* 6/2001 Muramatsu ..... G01P 3/36 84/658
2002/0194986 A1* 12/2002 Kato ..... G10H 1/0553 84/744
2005/0092160 A1* 5/2005 Fujiwara ..... G10F 1/02 84/600
2007/0039452 A1* 2/2007 Nishida ..... G10H 1/344 84/658
2008/0168892 A1* 7/2008 Uehara ..... G10H 1/0066 84/610
2009/0084248 A1* 4/2009 Furukawa ..... G10H 1/0058 84/609
2009/0100979 A1* 4/2009 Furukawa ..... G10H 1/0066 84/13
2015/0059557 A1* 3/2015 Sakata ..... G10H 1/34 84/609

* cited by examiner

PERFORMANCE INFORMATION OUTPUT CONTROL APPARATUS, KEYBOARD INSTRUMENT AND CONTROL METHOD THEREOF

CROSS REFERENCE TO RELATED APPLICATION(S)

This application is based upon and claims the benefit of priority of Japanese Patent Application No. 2014-127458 filed on Jun. 20, 2014, the contents of which are incorporated herein by reference in its entirety.

BACKGROUND OF THE INVENTION

1. Field of the Invention

The present invention relates to a performance information output control apparatus having a preceding output function, a keyboard instrument and a control method of the apparatus.

2. Description of the Related Art

An example of an automatic playing piano is configured to reproduce accompaniment based on accompaniment data so that a player can play the automatic playing piano according to the accompaniment thus reproduced. When a player can not follow the accompaniment thus reproduced, the automatic playing piano stops the accompaniment at every predetermined section and waits for performance of the player. Then, when the player presses down a key of a tone corresponding to the section, the automatic playing piano restarts the accompaniment (see JP-A-2008-175969). In this respect, when the accompaniment is restarted in response to detection of the press-down of the key by the player, there may arise a delay until the restart of the accompaniment after the detection of the press-down of the key. According to the method of JP-A-2008-175969, the press-down of the key is detected on the way of press-down of the key to the last and the accompaniment is restarted, whereby this delay is reduced.

In recent years, some of keyboard instruments such as an automatic playing piano is configured in a manner that music sound according to performance by the keyboard instrument is generated by an external device connected to the outside of the keyboard instrument. The external device is a wireless headphone, a wireless MIDI (Music Instrument Digital Interface) transmission system or the like, for example. When connecting a keyboard instrument via the Internet to perform a musical session, a sound signal of performance played at one location may be transmitted via the Internet to another keyboard instrument, thereby generating music sound based on the sound signal.

JP-A-2009-116325 discloses a technique that, in order to compensate delay of performance caused by communication at the time of performing a musical session via the Internet, a trajectory of a key after a predetermined time is predicted by detecting press-down of keys by a player, and then the key trajectory information is transmitted to a partner of the musical session. According to this technique, for example, the key trajectory information according to performance of a keyboard instrument at one location is transmitted to the musical session partner, and another keyboard instrument at the other location receives this key trajectory information. Then, when the other keyboard instrument performs performance based on the received key trajectory information, performance of the musical session partner can also be listened at the other location in a manner of reducing the delay caused by the communication.

Patent Literature 1: JP-A-2008-175969

Patent Literature 2: JP-A-2009-116325

SUMMARY OF THE INVENTION

When performing performance by a keyboard instrument connected to an external device and generating music sound based on the performance via the external device, it may take a time for the external device to perform a processing for generating music sound. Further, when an external device is connected via a network, it may take a time to transmit a music performance signal through the network. In each of these cases, as generation of sound music from the external device becomes later than performance of a user at the keyboard instrument, a user may feel discomfort. Further, in a case where a device (internal device) is provided within a keyboard instrument, generation of sound music from the device also becomes later than performance of a user at the keyboard instrument, like the external device. Thus, the user may also feel discomfort. Concerning the delay due to transmission via a network, the method of JP-A-2009-116325 has a problem that a complicated calculation is required in order to estimate a trajectory of key movement of the keyboard instrument.

A non-limited object of the present invention is to provide a performance information output control apparatus, a keyboard instrument and a control method of the apparatus, each of which can reduce a delay of sound generation timing according to music performance contents.

An aspect of the present invention provides a performance information output control apparatus including: a detection part which detects a plurality of positions of a music performance interface during a single stroke with respect to an operator of a keyboard instrument, the music performance interface including a mechanism that interlocks with the operator of the keyboard instrument; an estimated music-sound generation time analysis part which calculates an estimated music-sound generation time point representing a time point at which music sound according to the single stroke with respect to the operator is estimated to be generated, based on a detection result of the positions of the music performance interface by the detection part; and a music performance information output part which outputs, when the detection result by the detection part is obtained, music performance information representing music performance contents corresponding to the single stroke with respect to the operator prior to the calculated estimated music-sound generation time point.

The performance information output control apparatus may be configured such that the music performance information output part outputs, based on an output preceding time period determined according to a time period until music sound according to the single stroke with respect to the operator is generated, the music performance information when a current time point reaches a preceding output time point that is earlier than the estimated music-sound generation time point by the output preceding time period.

The performance information output control apparatus may be configured such that the estimated music-sound generation time analysis part obtains detection results corresponding to the plurality of positions of the music performance interface detected during the single stroke with respect to the operator, and calculates, based on each of the respective detection results thus obtained, a next detection time point at which next detection result is obtained after the time point where the each detection result is obtained and also calculates the estimated music-sound generation time point, and the music performance information output part outputs the music performance information when a current time point reaches the preceding output time point, in a case where the preceding output time point determined based on the estimated music-sound generation time point is prior to the next detection time point.

Another aspect of the present invention provides a keyboard instrument including; a plurality of operators; and the above mentioned performance information output control apparatus.

Still another aspect of the present invention provides a method of controlling a performance information output control apparatus, the method including; detecting a plurality of positions of a music performance interface during a single stroke with respect to an operator of a keyboard instrument the music performance interface including a mechanism that interlocks with the operator of the keyboard instrument; calculating an estimated music-sound generation time point representing a time point at which music sound according to the single stroke with respect to the operator is estimated to be generated, based on a detection result of the positions of the music performance interface; and outputting, when the detection result of the positions of the music performance interface is obtained, music performance information representing music performance contents corresponding to the single stroke with respect to the operator prior to the calculated estimated music-sound generation time point.

According to any of the aspects of the present invention, as the music performance information according to an operation of the music performance interface of the keyboard instrument is outputted prior to the estimated music-sound generation time point, a music sound generation timing of the device becomes close to the estimated music-sound generation time point. Thus, a delay of music sound generation timing at the device according to music performance contents of the keyboard instrument can be reduced.

BRIEF DESCRIPTION OF THE DRAWINGS

In the accompanying drawings.

DETAILED DESCRIPTION OF THE EXEMPLARY EMBODIMENTS

First Embodiment

Hereinafter, a keyboard instrument according to a first embodiment of the present invention will be explained with reference to the accompanying drawings.

Figure 1:
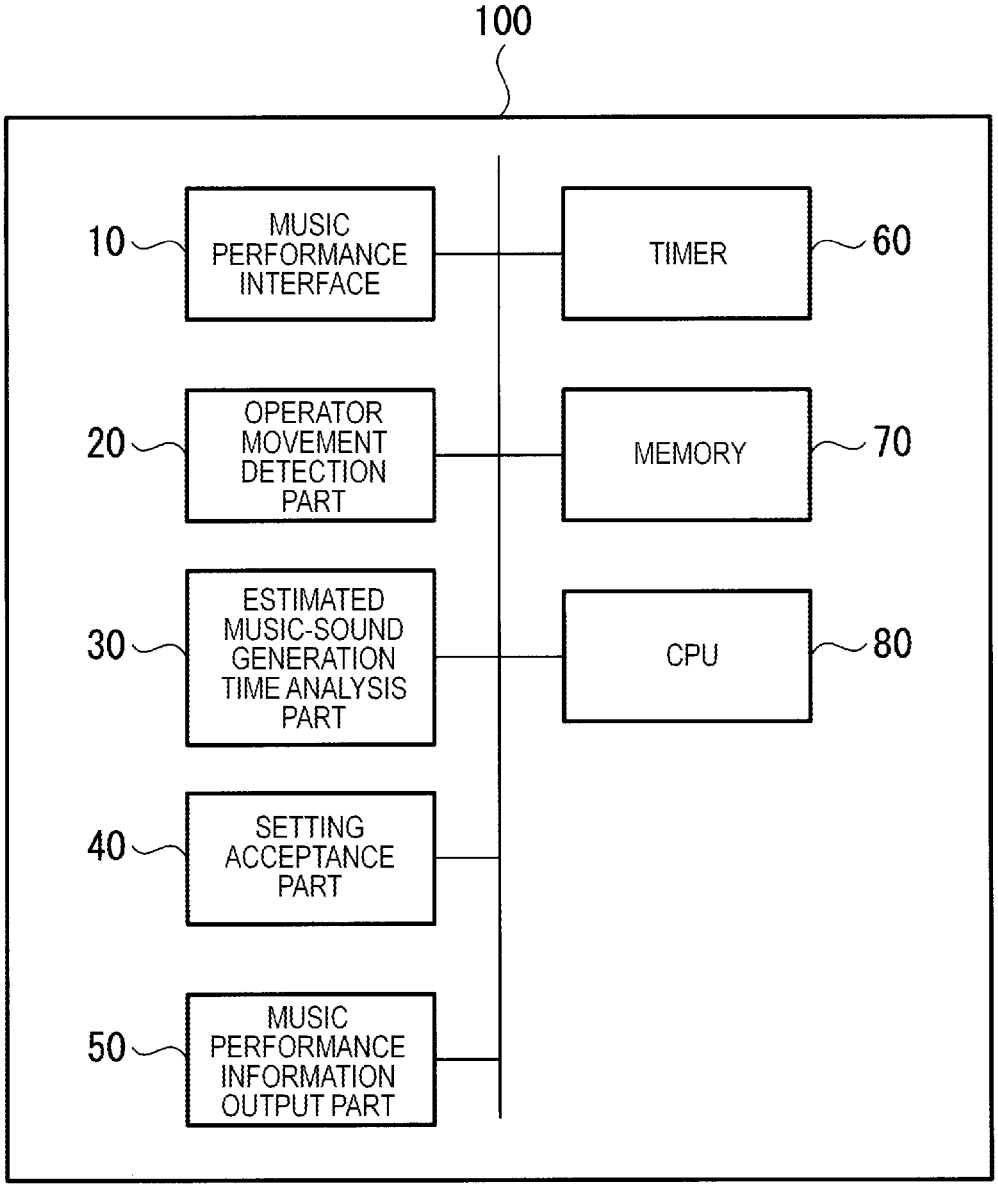
FIG. 1 is an example of a functional block diagram of a keyboard instrument according to a first embodiment of the present invention.

FIG. 1 is an example of a functional block diagram of the keyboard instrument according to the first embodiment.

As shown in FIG. 1, the keyboard instrument 100 according to the first embodiment includes a music performance interface 10, an operator movement detection part 20, an estimated music-sound generation time analysis part 30, an acceptance part 40, a music performance information output part 50, a timer 60, a memory 70 and a CPU 80.

The keyboard instrument 100 is a musical instrument which outputs music sound according to performance (key operations) of a user. In this embodiment, the keyboard instrument 100 is a piano (acoustic piano) which can output music performance information as a music performance signal. More specifically, the keyboard instrument 100 generates music sound when a hammer strikes a string according to a key operation, as described later. Further, the keyboard instrument can also generate and output a music performance signal representing music performance information based on key operations. An example of a music performance signal is a signal compliant with MIDI. In this embodiment, there are two kinds of timings at which the keyboard instrument 100 outputs a music performance signal. The first is a normal output timing. At the normal output timing, a music performance signal is outputted so that music sound based on the music performance signal is generated at a timing at which a hammer strikes a string and generates music sound according to a key operation of a user. A mode where the music performance signal is outputted at the normal output timing is called a normal mode. The second is a preceding output timing (preceding output time point). At the preceding output timing, a music performance signal according to performance of a user is outputted at a timing before a string is actually struck by a hammer according to a key operation of the user. A mode where a music performance signal is outputted at the preceding output timing is called a preceding mode. The keyboard instrument 100 can output sound from a speaker provided at the keyboard instrument 100 based on a music performance signal. Further, the keyboard instrument 100 can output a music performance signal to the outside.

The music performance interface 10 includes operators for performing input operations according to music performance contents by a user and mechanisms interlocked with the operators. The operators are keys and pedals, for example. The interlocking mechanisms are a so-called hammer action mechanism and a so-called pedal action mechanism, for example.

The operator movement detection part 20 is a sensor which detects movements of keys and a string striking mechanism interlocking with the keys of the keyboard instrument 100. A key press operation state and a key release operation state detected by the operator movement detection part 20 are collectively referred to a music performance state. Each of the music performance interface 10 and the operator movement detection part 20 will be explained in detail later with reference to FIG. 2.

The estimated music-sound generation time analysis part 30 calculates an estimated music sound generation time point which is a time point where music sound according to an operation of an operator is generated. This calculation is performed based on a detection result of a music performance state of the operator of the keyboard instrument 100 which is detected at a halfway stage of music performance operation by the operator and obtained from the operator movement detection part 20. For example, the estimated music-sound generation time analysis part 30 calculates a speed of the hammer and a normal output timing based on movement of the hammer having been detected, thereby estimating the music sound generation time point.

The setting acceptance part 40 accepts an operation input for setting the operation mode of the keyboard instrument 100 to one of the normal mode, the preceding mode and both of these modes. The setting acceptance part 40 also accepts an operation input for setting output preceding time information representing an output preceding time period and stores this information in the memory 70. The output preceding time period is determined according to a time period until music sound of a music performance signal is generated from a device after the music performance signal is generated in the keyboard instrument 100.

When a detection result of a music performance state of an operator is obtained, the music performance information output part 50 outputs music performance information representing music performance contents corresponding to the music performance operation by the operator, to the device connected to the keyboard instrument 100, prior to the estimated music sound generation time point. Music performance information represents, in a case of operating a key, for example, an identifier specifying the key and a position in a depth direction of the key at the time of pressing or releasing the key. In the case of operating a pedal, music performance information represents an identifier specifying the pedal and a position in a depth direction of the pedal. Further the music performance information output part 50 generates a music performance signal corresponding to music performance contents and outputs to this signal to the device connected to the keyboard instrument 100.

The music performance information output part 50 calculates a preceding output timing of a music performance signal based on a normal output timing calculated by the estimated music-sound generation time analysis part 30 and output preceding time information set by the setting acceptance part 40, and performs a control of outputting the music performance signal to the device at the calculated preceding output timing. The device in this case is a device which is connected to the keyboard instrument 100 and constitutes at least a part of a path until generation of music sound based on a music performance signal generated from the keyboard instrument 100. More specifically, the device is a wireless audio transceiver, a wireless headphone, a wireless MIDI transceiver, a MIDI sound source or an Internetan Internet session device, for example. The device according to the present invention is not limited to one connected to the outside of the keyboard instrument 100 but may be one provided within the keyboard instrument 100.

The timer 60 clocks a time point at which the operator movement detection part 20 detects movement of an operator, and a time in a case of adjusting an output timing of the music performance information output part 50.

The memory 70 is a memory device such as an ROM (Read Only Memory), an RAM (Read Access Memory), an HDD (hard disk drive) or a flash memory. The memory 70 stores respective application programs and various kinds of setting information etc. to be executed by the CPU (Central Processing Unit). The memory 70 stores an output preceding time period corresponding to the device connected to the keyboard instrument 100.

The CPU 80 controls respective parts of the keyboard instrument 100.

Figure 2:
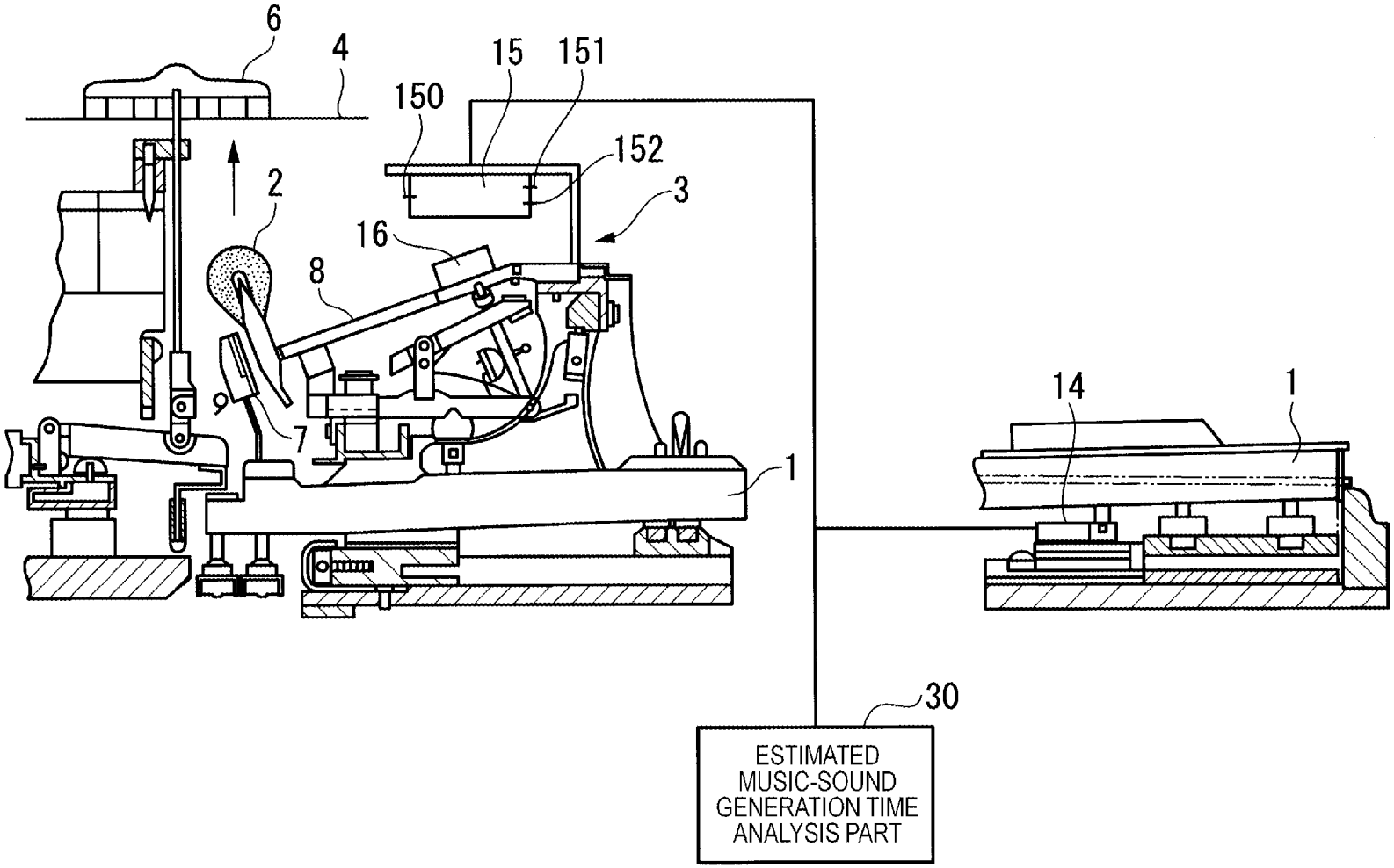
FIG. 2 is an example of an explanatory diagram showing an interior configuration of a main portion of the keyboard instrument according to the first embodiment of the present invention.

FIG. 2 is an example of an explanatory diagram showing an interior configuration of a main portion of the keyboard instrument according to the first embodiment of the present invention. FIG. 2 shows the interior configuration of the main portion of the keyboard instrument 100 in a case where the keyboard instrument is an automatic playing piano. FIG. 2 contains the music performance interface 10 and shows the periphery of the performance interface.

The keyboard instrument 100 includes action mechanisms 3 each acting as a string striking mechanism for transmitting movement of a key 1 to a hammer 2, strings 4 each struck by corresponding one of the hammers 2 and dampers 6 for stopping vibration of corresponding one of the strings 4. Like a normal piano, the keyboard instrument 100 is provided with back checks 7 each of which prevents movement of the hammer 2 when the hammer 2 returns to the hammer action mechanism after striking the string. Further, the keyboard instrument 100 is provided with mechanisms similar to those mounted in a normal piano. The keyboard instrument 100 is further provided with not-shown stoppers each of which prevents the hammer 2 from striking the string. Each of the stoppers is mechanically movable between a position for preventing the string striking and a position for allowing the string striking, according to an instruction or operation of a player.

A key sensor 14 is provided beneath (downward direction seen from a player) the lower surface of each of the keys 1 so as to detect movement of the corresponding key 1. The key sensor 14 includes an optical source and an optical sensor. The optical source emits light toward the optical sensor. The optical sensor detects light emitted from the optical source. Further, the key 1 has a not-shown shutter protrusively formed at the bottom portion thereof. When the key 1 is pressed down, the shutter interrupts light emitted from the optical source to the optical sensor, thereby changing a light quantity detected by the optical sensor. The key sensor 14 outputs information representing a light quantity detected by the optical sensor to the estimated music-sound generation time analysis part 30. The estimated music-sound generation time analysis part 30 can calculate a position, speed and acceleration of the key having been operated based on the information.

The hammer sensor 15 is provided between the hammer shank 8 and the string 4. The hammer sensor 15 includes an optical source 150 and optical sensors 151, 152. The optical source 150 is provided at one end of the hammer sensor in the axial direction of the hammer shank 8. This one end corresponds to one end side (deep side seen from a player) of the hammer shank at which the hammer 2 is provided. The optical source 150 emits light toward the optical sensors 151, 152. Each of the optical sensors 151, 152 is provided at the other end of the hammer sensor in the axial direction of the hammer shank 8. The other end corresponds to the other side (near side seen from a player) of the hammer shank in opposite to the one end side at which the hammer 2 is provided. The optical sensors 151, 152 are disposed so as to be aligned in an up-down direction (direction connecting between the string 4 side and the key 1 side).

A shutter 16 is provided at a portion of the hammer shank 8. When the hammer 2 moves toward the string 4 in response to the press-down of the key 1, the hammer shank 8 moves upward. In accordance with this movement of the hammer shank, the shutter 16 interrupts light emitted from the optical source 150 to the optical sensors 151, 152. As a result, a light quantity received by each of the optical sensors 151, 152 changes. The hammer sensor 15 detects changing amounts of the light quantities and the detection order of the changing amount between the optical sensors 151, 152, whereby movement of the hammer 2 moving toward the string 4 can be detected. The estimated music-sound generation time analysis part 30 can detect a string striking speed of the hammer 2 based on a detection result of the hammer sensor 15. That is, the estimated music-sound generation time analysis part can detect a string striking speed of the hammer 2 based on a distance between the optical sensor 151 and the optical sensor 152 and a time difference between a time point at which light emitted from the optical source 150 to the optical sensor 151 is interrupted by the shutter 16 and a time point at which the light emitted from the optical source 150 to the optical sensor 152 is interrupted by the shutter 16. The time point, at which the light emitted from the optical source 150 to the optical sensor 151 or 152 is interrupted by the shutter 16, means a time point clocked by the timer 60 when the estimated music-sound generation time analysis part 30 obtains from the hammer sensor 15 a detection signal which represents that the light emitted from the optical source 150 to the optical sensor 151 or 152 is interrupted by the shutter 16. Further, the estimated music-sound generation time analysis part 30 calculates a string striking timing based on the string striking speed of the hammer 2 thus detected and a distance from a position of the shutter 16 at which the shutter passes the optical sensor 151 to a position of the shutter 16 at which the hammer 2 strikes the string 4. The key sensor 14 and the hammer sensor 15 correspond to the operator movement detection part 20.

Figure 3A:
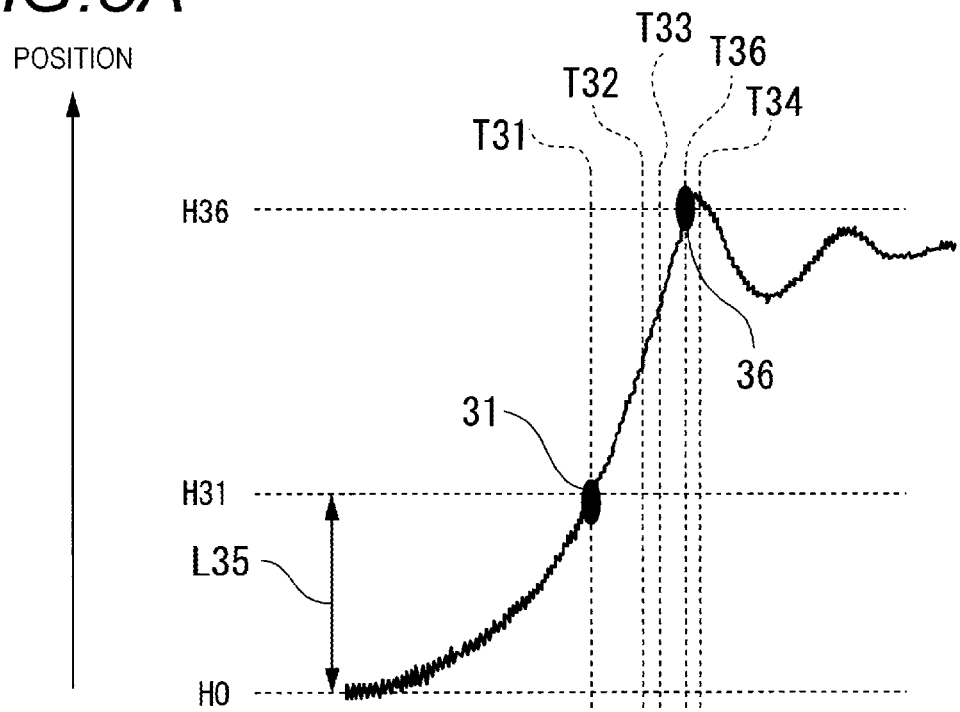
FIGS. 3A and 3B are graphs for explaining movement of a hammer according to the first embodiment of the present invention.
Figure 3B:
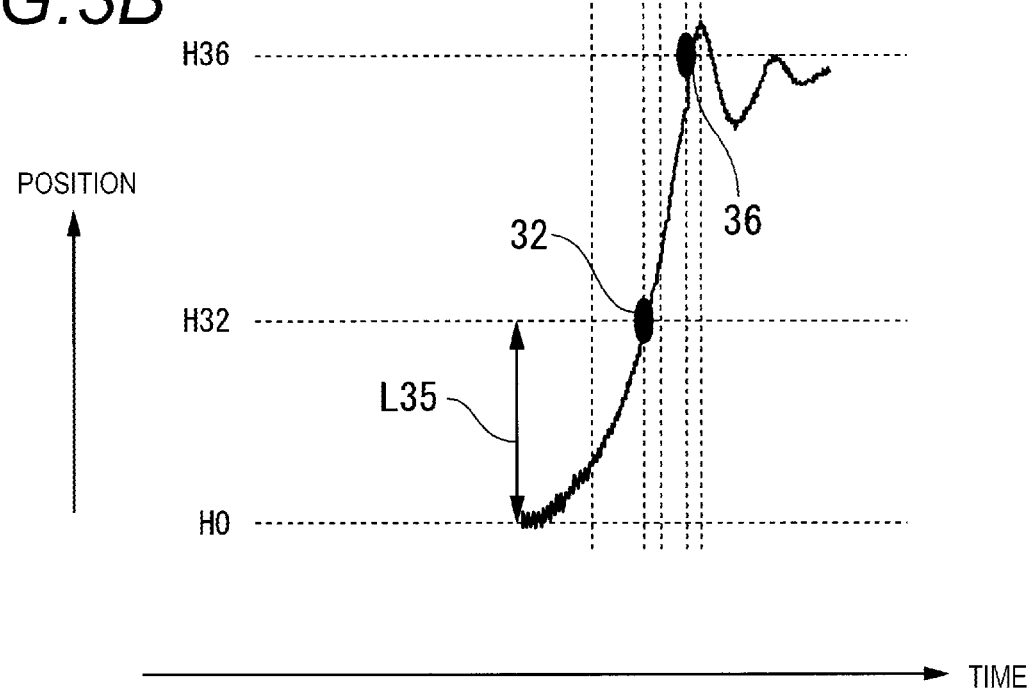

FIGS. 3A and 3B are graphs for explaining movement of the hammer according to the first embodiment of the present invention.

FIG. 3A is a graph for explaining movements and detection timings of the movement of the hammer 2 interlocked with the key 1 in a case where the keyboard instrument 100 outputs a weak sound based on the movement of the key 1. In FIG. 3A, the ordinate represents a position of the hammer 2 in a moving direction thereof and the abscissa represents a time. The hammer 2 locates at a position H0 before a user presses the key 1 down. This position is called a reference position H0. When a user presses the key 1 down, the hammer 2 moves toward the string 4 in accordance with the press-down of the key 1 and strikes the string 4 at a string striking timing (time point T34). A reference numeral 36 represents a position and a timing at which the hammer sensor 15 detects movement of the hammer 2, in the case of the normal mode. Supposing that this detection point is a position H36 and this detection timing is a time point T36, the time point T36 corresponds to a time point at which the hammer 2 reaches a position just before the hammer 2 strikes the string 4. In the case of the normal mode, the hammer sensor 15 detects passing of the hammer 2 at the position H36. Based on the detection result of the hammer sensor 15, the estimated music-sound generation time analysis part 30 calculates a string striking speed, representing a speed of the hammer when the hammer 2 reaches the position just before the hammer 2 strikes the string 4, and also calculates a string striking timing representing a time point at which the hammer 2 strikes the string 4. The music performance information output part 50 outputs a music performance signal corresponding to the press-down of the key 1 by a user when the current time reaches the string striking timing (time point T34) calculated by the estimated music-sound generation time analysis part 30. This string striking timing is the normal output timing. An operation by a user from starting pressing down one key 1 to the string striking may be called as a single stroke. For example, when the user performs one stroke to the key 1, a sound corresponding to the press-down of the key 1 is emitted from the speaker.

However, according to this operation, there may arise a problem at the time of generating music sound from the device connected to the keyboard instrument 100. More specifically, before music sound due to string striking of the hammer is generated, it is necessary to transmit a music performance signal to the device and perform signal processing of the music performance signal in the device. However, there may arise a case that this transmission of the music performance signal and this signal processing of the music performance signal are not completed before music sound due to the string striking of the hammer is generated. In this case, there arises a problem that a timing at which music sound according to the music performance signal is generated from the speaker becomes later than the timing (time point T34) calculated by the estimated music-sound generation time analysis part 30. As a result, music sound according to the music performance signal is generated from the speaker after music sound due to string striking of the hammer is generated. According to the embodiment, such the delay of generation of the music sound based on the music performance signal is reduced by providing the preceding mode in which the music performance signal is outputted at a timing earlier than that of the normal mode.

Next, the preceding mode will be explained with reference to FIG. 3A. A reference numeral 31 represents a position and a timing at which the hammer sensor 15 detects movement of the hammer 2, in the case of the preceding mode. Supposing that this detection point is a position H31 and this detection timing is a time point T31, the hammer sensor 15 detects movement of the hammer 2 at the position H31. The position H31 is provided at a position closer to the reference position H0 of FIG. 2 than the position H36 so that movement of the hammer 2 can be detected at an earlier timing. The estimated music-sound generation time analysis part 30 analyzes movement of the hammer 2 based on a detection result of the hammer sensor 15 and calculates a string striking timing and a string striking speed of the hammer. Then, the music performance information output part 50 generates a music performance signal at a preceding output timing (time point T33) which is earlier than the string striking timing by the output preceding time period stored by the setting acceptance part 40.

In the preceding mode according to the embodiment, movement of the hammer 2 is detected at a timing earlier than that of the normal mode. To this end, for example, the hammer sensor 15 is provided on the lower side (at a portion closer to the hammer shank 8) than the conventional position. Alternatively, an end portion of the shutter 16 may be extended on an upper side (hammer sensor 15 side) to a position close to the optical source 150 and the optical sensors (151, 152). Alternatively, setting of the hammer sensor 15 may be changed. By so doing, movement of the hammer 2 can be detected at a timing earlier than that of the normal mode. According to this configuration, the hammer sensor 15 detects movement of the hammer 2 on the way to a position just before the hammer 2 strikes the string 4. For example, the hammer sensor 15 detects movement of the hammer 2 at the position 31 which away from the reference position H0 by a distance L35. In this respect, the distance L35 is shorter than a distance between the reference position H0 and the position H36.

Next, explanation will be made with reference to FIG. 3B as to a case where the keyboard instrument 100 outputs a strong sound. FIG. 3B is a graph for explaining movements of the hammer 2 and detection timings thereof in a case where the keyboard instrument 100 outputs a strong sound. In a case of a strong sound, a user presses the key 1 down forcefully as compared with a case of a weak sound. In this case, a speed of the hammer 2 is faster as compared with that in the case of outputting a weak sound. A time required for the hammer 2 to move from the reference position H0 to the position H36 is shorter as compared with that in the case of outputting a weak sound. Thus, a time period, required to reach a preceding output timing after detection of the movement of the hammer 2, is shorter than that in the case of outputting a weak sound. For example, in a case of outputting a weak sound, as shown in FIG. 3A, movement of the hammer 2 is detected at the time point T31 and a music performance signal is outputted at the time point T33 determined in correspondence to the output preceding time period. In contrast, in a case of outputting a strong sound, as shown in FIG. 3B, movement of the hammer 2 is detected at a time point T32 and a music performance signal is outputted at the time point T33 determined in corresponding to the preceding output timing. Thus, in FIG. 3B, in a case of outputting a strong sound, a time period required to reach the preceding output timing after detection of the movement of the hammer 2 is shorter than that in the case of outputting a weak sound, by a time period from the time point T31 to the time point T32. Accordingly, the estimated music-sound generation time analysis part 30 changes a time period from detection of the movement of the hammer 2 to outputting of a music performance signal, according to a speed of the hammer 2 obtained from a detection result of the hammer sensor 15. As an example, the estimated music-sound generation time analysis part sets a time period, from detection of the movement of the hammer 2 to outputting of a music performance signal, to be shorter as a speed of the hammer 2 becomes faster. In this manner, in a case of outputting a strong sound and a weak sound, even when a speed of the hammer 2 differs therebetween, a music performance signal can be reached the device at a suitable timing according to a speed of the hammer 2.

In view of this, according to the embodiment, the hammer sensor 15 detects movement of the hammer 2 when the hammer moves upward to a position, that is, a position H32, separated by the distance shown by the reference numeral L35 from the reference position H0. Then, the estimated music-sound generation time analysis part 30 calculates a string striking timing based on the speed of the hammer 2. The music performance information output part 50 outputs a music performance signal at the preceding output timing (time point T33) which is earlier than the string striking timing (time point T34) by the output preceding time period. In a case of a strong sound, as the hammer moves up abruptly, a time period between the time point T32 as the detection timing and the preceding output timing T33 becomes short.

Although the explanation is made, for example, as to the method of advancing the output timing of a music performance signal based on detection of the movement of the hammer 2, the output timing of a music performance signal may be controlled based on movement of the key 1 detected using the key sensor 14. More specifically, the estimated music-sound generation time analysis part 30 calculates a position and press-down speed of the key 1 and estimates the normal output timing, based on a light quantity detected by the key sensor 14 and a changing amount thereof. Thereafter, the music performance information output part 50 outputs a music performance signal at a preceding output timing earlier than the normal output timing by the output preceding time period.

Alternatively, a timing of outputting, a detection result of a pedal sensor for detecting an operation state of the pedal, to the device may be controlled. For example, the pedal sensor detects step-in position and speed of the pedal at a stage before the damper 6 reaches a position separating from the string 4. Then, the estimated music-sound generation time analysis part 30 estimates a normal output timing at which a music performance signal representing music performance contents according to the stepped-in pedal is outputted. Thereafter, the music performance information output part 50 outputs a music performance signal at a preceding output timing earlier than the normal output timing by the output preceding time period.

Figure 4:
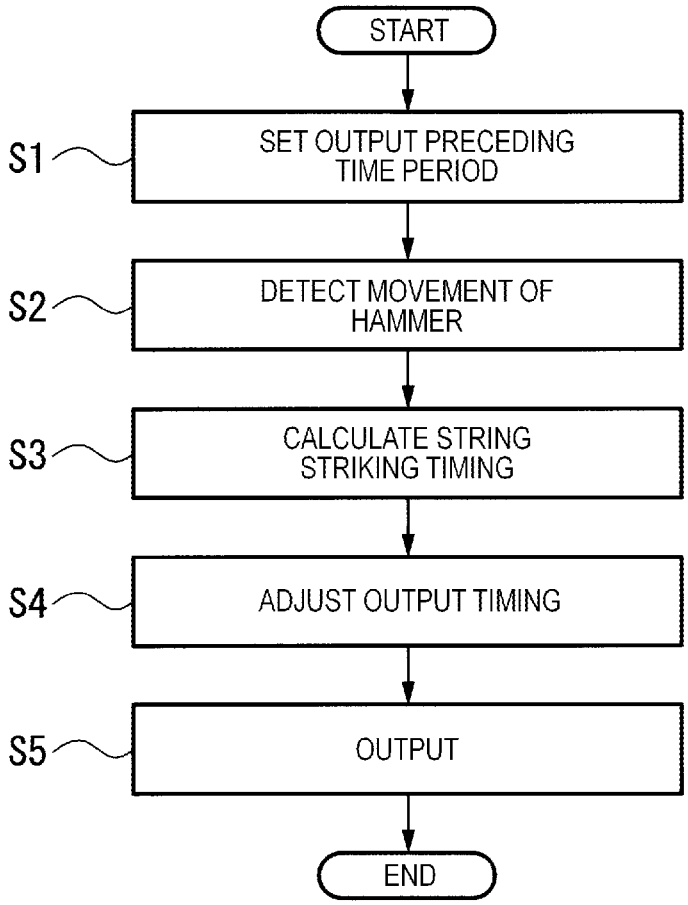
FIG. 4 is a flowchart for explaining an operation of the keyboard instrument according to the first embodiment of the present invention.

FIG. 4 is a flowchart for explaining an operation of the keyboard instrument according to the first embodiment of the present invention.

A preceding output processing of a performance signal from the keyboard instrument 100 according to the embodiment will be explained with reference to FIG. 4.

Firstly, a user inputs, from the setting acceptance part 40, an instruction for setting the operation mode to the preceding mode. Further, a user sets an output preceding time period in the current music performance environment. The output preceding time period can be changed according to the device to be connected. For example, when a user uses a headphone wirelessly connected to the keyboard instrument 100 as the device, the user presses down a button representing "headphone". When the "headphone" is designated by way of the setting acceptance part 40, the music performance information output part 50 reads "10 msec" stored in the memory 70 in association with this device and sets as the output preceding time period (step S1).

Next, when the user starts music performance using the keyboard instrument 100, each of the hammer sensors 15 detects movement of corresponding one of the hammers 2 each time corresponding one of the keys 1 is operated (each stroke) (step S2). When the optical sensors 151, 152 detect passing of the shutter 16, the hammer sensor 15 outputs a detection signal to the estimated music-sound generation time analysis part 30 each time each of these optical sensors detects the passing of the hammer 2.

The estimated music-sound generation time analysis part 30 calculates a string striking speed and string striking timing of the hammer 2 based on the detection result of the hammer sensor 15 (step S3). The estimated music-sound generation time analysis part 30 outputs, to the music performance information output part 50, the string striking timing thus calculated, an identifier of the key 1 pressed down by the user and the string striking speed of the hammer 2.

The music performance information output part 50 calculates a preceding output timing which is a time point earlier than the string striking timing by the output preceding time period, based on the string striking timing (estimated string-striking time point) and the output preceding time period. Then, the music performance information output part 50 adjusts the output timing of a music performance signal (step S4). To be concrete, the music performance information output part 50 waits outputting of a music performance signal until a time represented by the timer 60 reaches the preceding output timing thus calculated. The music performance information output part generates a music performance signal representing music performance information according to a key operation, based on the identifier of the key 1 pressed down by the user and the string striking speed of the hammer 2 each obtained from the estimated music-sound generation time analysis part 30. When a time represented by the timer reaches the preceding output timing thus calculated, the music performance information output part 50 outputs the music performance signal thus generated (step S5).

According to the embodiment, a string striking timing at a time of operating the hammer 2 is calculated based on information detected by the optical sensors. Then, the control is performed in a manner that a music performance signal is outputted at a timing earlier than the string striking timing by the calculated output preceding time period. Thus, even in a case of connecting a device to the keyboard instrument 100 and outputting a music performance signal from the device, a delay caused by passing the music performance signal through the device can be cancelled by the advanced time period of the output timing of the signal. Thus, advantageously, output of a music performance signal from the device is less likely delayed. Further, according to the embodiment, a movement of the key is detected at plural stages on the way of music performance, an output timing of a music performance signal can be calculated with simple arithmetic operations without requiring complicated calculations such as estimation of a key trajectory.

Figure 5A:
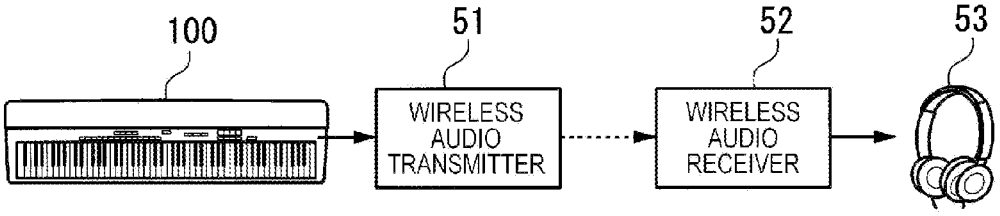
FIGS. 5A to 5C are diagrams each showing configuration of a music performance system in which a device is connected to the keyboard instrument, according to the first embodiment of the present invention.
Figure 5B:
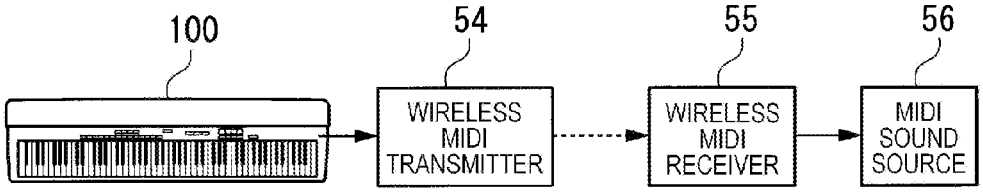
Figure 5C:
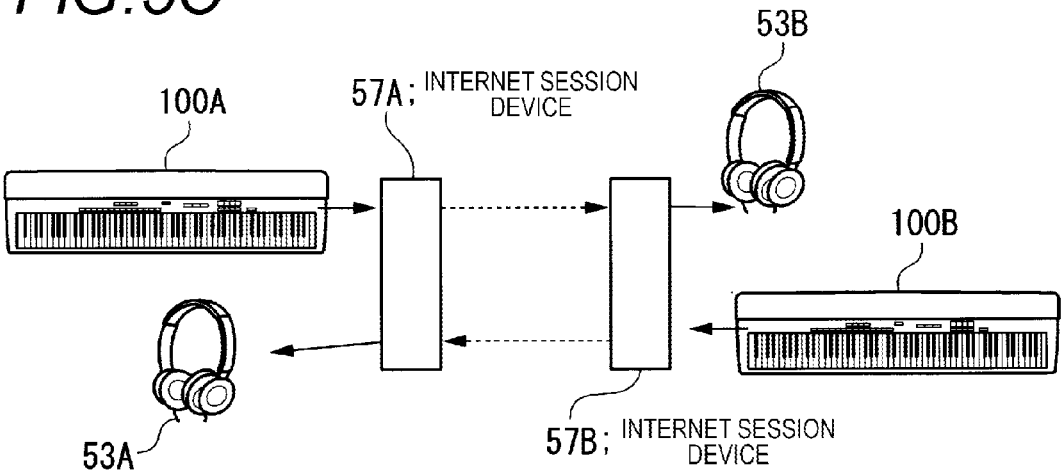

FIGS. 5A to 5C are diagrams each showing configuration of a music performance system in which a device is connected to the keyboard instrument 100, according to the first embodiment of the present invention.

FIG. 5A is a diagram showing configuration in a case of wirelessly connecting a headphone 53 to the keyboard instrument 100. A wireless audio transmitter 51 is connected to the keyboard instrument 100. The wireless audio transmitter obtains a music performance signal outputted from the music performance information output part 50 of the keyboard instrument 100 and wirelessly transmits this signal to a wireless audio receiver 52. The wireless audio receiver 52 receives the music performance signal transmitted from the wireless audio transmitter 51. The wireless audio receiver 52 may be provided within the headphone 53. The headphone 53 generates music sound based on the music performance signal received by the wireless audio receiver 52.

In the normal mode, the keyboard instrument 100 detects movement of the hammer 2 at the time point T36 (FIG. 3A) just before the hammer 2 strikes the string 4, and then outputs a music performance signal from the music performance information output part 50. In this case, a transmission time (12 msec, for example) is required for performing a transmission and reception processing of this music performance signal. This transmission time means a time period from the string striking timing at the time point T34 to a timing at which the music performance signal transmitted through the wireless audio transmitter 51 and the wireless audio receiver 52 is generated as music sound from the headphone 53. When this transmission time becomes longer, a delay time from press-down of the key in the keyboard instrument until generation of music sound based on the music performance signal at the headphone becomes longer. As a result, a user may feel discomfort. In contrast, in the preceding mode, a music performance signal is outputted from the music performance information output part 50 at the time point T31 which is earlier than the time point T34 (FIG. 3A) by the output preceding time period (10 msec, for example). Thus, the time period from the press-down of the key in the keyboard instrument 100 to the generation of music sound based on the music performance signal at the headphone 53 can be shortened to about 2 msec, and hence the delay time can be reduced. Accordingly, a user unlikely feels discomfort.

Next, FIG. 5B is a diagram showing configuration in a case of wirelessly connecting an MIDI sound source 56 to the keyboard instrument 100. A wireless MIDI transmitter 54 is connected to the keyboard instrument 100. The wireless MIDI transmitter obtains MIDI data as a music performance signal outputted from the music performance information output part 50 of the keyboard instrument 100 and wirelessly transmits the MIDI data to a wireless MIDI receiver 55. The wireless MIDI receiver 55 receives the MIDI data transmitted from the wireless MIDI transmitter 54. The MIDI sound source 56 outputs an analog audio signal according to the MIDI data received by the wireless MIDI receiver 55, whereby music sound based on the MIDI data is generated from the speaker. Even when the MIDI sound source 56 is connected as the device to the keyboard instrument, the keyboard instrument 100 can output the MIDI data from the music performance information output part 50 at a time point earlier than the string striking timing by the output preceding time period. Thus, even in a case of wirelessly transmitting MIDI data, a time period from press-down of the key in the keyboard instrument 100 until generation of music sound based on the MIDI data at the speaker via the MIDI sound source 56 can be shortened.

Next, FIG. 5C is a diagram showing configuration in a case of connecting a plurality of the keyboard instruments 100 through the Internet. In this case, a keyboard instrument 100A and a keyboard instrument 100B each serving as the keyboard instrument 100 are connected to each other through an Internetan Internet session device 57A and an Internetan Internet session device 57B. A headphone 53A is connected to the Internet session device 57A and worn on a player of the keyboard instrument 100A. A headphone 53B is connected to the Internet session device 57B and worn on a player of the keyboard instrument 100B. For example, according to this configuration, the plurality of keyboard instruments 100 are connected to each other through the Internet, and hence a musical session can be performed among players at remote places.

In this configuration, a music performance signal according to music performance contents in the keyboard instrument 100A is transmitted from the Internet session device 57A to the Internet session device 57B via the Internet. Music sound based on this music performance signal is generated from the headphone 53B together with music sound based on a music performance signal from the keyboard instrument 100B. The music performance signal according to music performance contents in the keyboard instrument 100B is transmitted from the Internet session device 57B to the Internet session device 57A via the Internet. Music sound based on this music performance signal is generated from the headphone 53A together with music sound based on the music performance signal from the keyboard instrument 100A. Each of a user A and a user B can play the keyboard instrument while wearing the headphone 53A or 53B and listening to both music sound performed by himself/herself and music sound performed by the partner.

In this respect, when it takes 30 msec to transmit and receive a music performance signal between the keyboard instrument 100A and the keyboard instrument 100B in the normal mode, there arises a delay time of 30 msec from output of a music performance signal on the partner side until generation of music sound based on this music performance signal from the headphone 53A or 53B. Thus, there arises a case that it is difficult to perform a musical session. In contrast, in the preceding mode, a music performance signal is outputted from the keyboard instrument (100A or 100B) on the partner side at a time point earlier than the string striking timing on the partner side by the output preceding time period (30 msec, for example). As a result, even in a case of performing a musical session through the Internet, a time period from music sound generation on one player side based on a music performance signal by the one player until music sound generation on the other player side based on this music performance signal can be shortened. Further, music sound based on a music performance signal from the own side is generated in synchronous with own performing timing. Thus, even in a case of connecting a plurality of the keyboard instruments 100 through the Internet to perform a musical session, both music sound based on a music performance signal from the own side and music sound based on a music performance signal on the partner side at a remote place can be generated at a timing closer to actual performing timings thereof.

FIG. 5C may be configured in the following manner in place of using the Internet session devices. That is, each of the keyboard instruments 100A, 100B outputs MIDI data as a music performance signal, and a MIDI transmitter on the own side transmits the MIDI data to a musical session partner side. In environment of the musical session partner side, a MIDI receiver receives the MIDI data and a MIDI sound source generates music sound based on the received MIDI data.

In this manner, a delay of generation timing of music sound according to music performance contents can be reduced. As generation of music sound according to music performance contents, for example, when the music performance contents is an operation of pressing the key down, a timing of generating music sound corresponding to the key-pressing from the device is made closer to a timing of generating music sound from the keyboard instrument 100. For example, when the music performance contents is an operation of stepping-in of a damper pedal, music sound corresponding to effects of the stepping-in of the damper pedal is generated from the device.

Second Embodiment

Next, a second embodiment according to the present invention will be explained with reference to FIG. 6.

Figure 6:
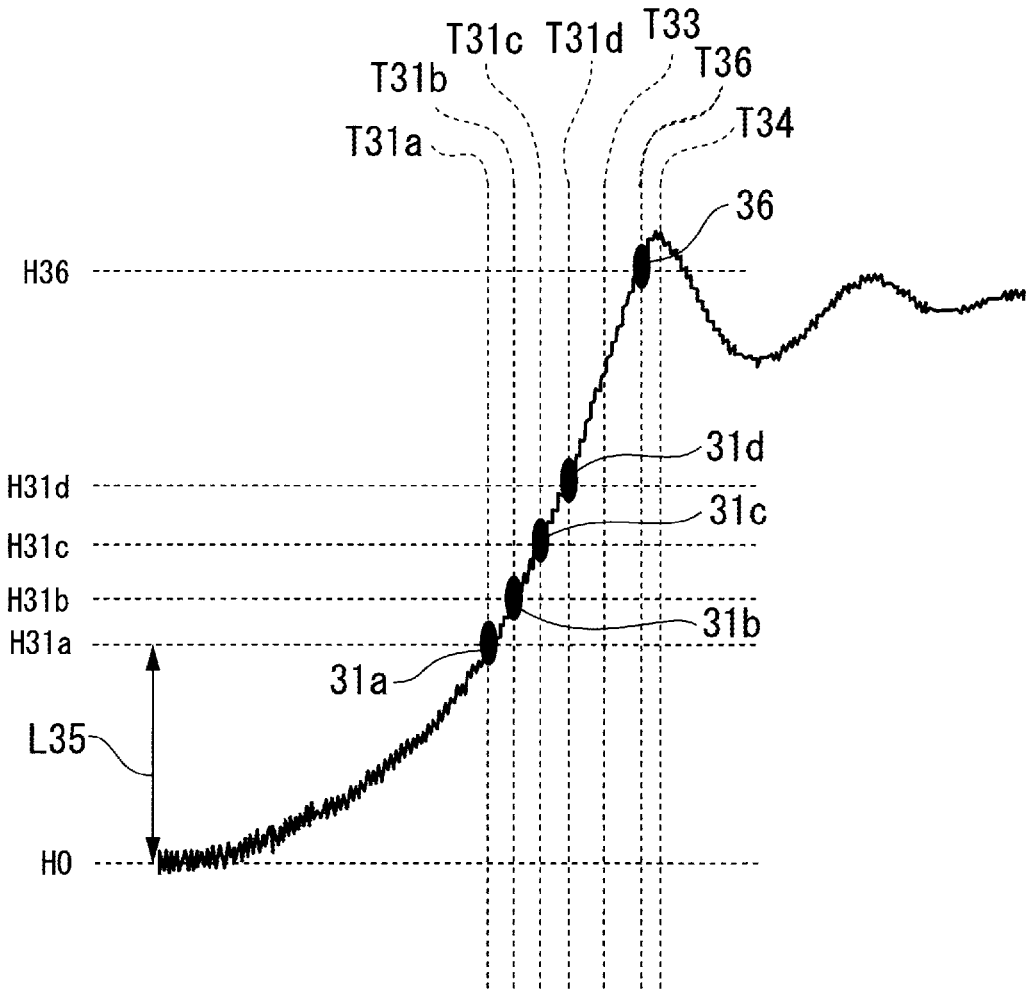
FIG. 6 is a diagram for explaining an operation of the hammer according to a second embodiment of the present invention.

FIG. 6 is a graph for explaining movement of the hammer according to the second embodiment of the present invention.

The second embodiment differs from the first embodiment in a point that an estimated music-sound generation time analysis part 30 estimates the string striking timing based on movement of the hammer 2 using a plurality of the detection points. The example of FIG. 6 corresponds to a case where five optical sensors are provided. Each of reference numerals 31*a* to 31*d* represents a position of the hammer and a timing at which the hammer sensor 15 detects movement of the hammer 2. A position shown by the reference numeral 31*a* is represented by H31*a* and a time point shown by the reference numeral 31*a* is represented by T31*a*. This is applied to each of the other reference numeral 31*b* to 31*d*. Each of the positions 31*a*, 31*b*, 31*c* and 31*d* represents a position where corresponding one of the optical sensors is provided.

The hammer sensor 15 notifies that passing of the hammer 2 is detected to the estimated music-sound generation time analysis part 30 each time the shutter 16 passes the detection points provided with the optical sensors. When the estimated music-sound generation time analysis part 30 obtains the detection results, the estimated music-sound generation time analysis part calculates a speed of the hammer 2 and a string striking timing, for example, based on a time period until the hammer passes the current detection point after the hammer passes the detection point just before the current detection point. Further, the estimated music-sound generation time analysis part 30 calculates a next point passing timing at which the hammer 2 passes the next detection point, based on a distance between the adjacent detection points and the calculated speed of the hammer 2. In this manner, when the estimated music-sound generation time analysis part 30 obtains the current detection result from the hammer sensor 15, the estimated music-sound generation time analysis part calculates, based on the obtained current detection result, an estimated time point at which the next detection result will be obtained just after the time point where the current detection result is obtained and also calculates a string striking timing (normal output timing).

When the estimated music-sound generation time analysis part 30 performs the aforesaid calculations based on newest detection information each time the shutter 16 passes the detection points, the estimated music-sound generation time analysis part outputs the string striking timing and the next detection point passing timing to the music performance information output part 50.

Further, the estimated music-sound generation time analysis part 30 outputs the identifier of the key 1 pressed down by a user and the speed of the hammer 2 to the music performance information output part 50.

The music performance information output part 50 reads the output preceding time information stored in the setting acceptance part 40. Then, the music performance information output part calculates a time pint (preceding output timing) earlier than the obtained string striking timing by the output preceding time period, each time information of the string striking timing is obtained from het estimated music-sound generation time analysis part 30. The music performance information output part 50 thereafter compares the calculated preceding output timing with the next detection point passing timing obtained from the estimated music-sound generation time analysis part 30. When the next detection point passing timing is later than the preceding output timing, the music performance information output part decides to output a music performance signal at the preceding output timing currently calculated. Then, the music performance information output part 50 outputs the music performance signal at the preceding output timing thus decided.

A speed of the hammer 2 according to press-down of the key 1 is not constant because this speed differs depending on a volume of music sound to be generated. A speed of the hammer 2 may increase on the way of the key pressing depending on how the key 1 is pressed down. When a string striking timing is estimated based on a speed of the hammer 2 detected at a time point closer to the normal output timing, a string striking timing can be estimated more accurately. For example, in a case of weak sound, even when a string striking timing is estimated based on information detected by the optical sensor at the position H31*d*, outputting of a music performance signal may be in time for the preceding output timing. In this case, when a string striking timing is estimated based on a speed of the hammer detected at the time point T31*d* closer to the normal output timing, it is considered that a string striking timing can be estimated more accurately. Further, when a music performance signal can be outputted at a preceding output timing calculated based on a more accurate string striking timing, it is considered that accuracy of reduction of a generation delay of music sound based on the music performance signal from the device can be improved. Accordingly, in this embodiment, each time the shutter passes the detection points, a timing at which the shutter will pass through the next detection point is compared with a preceding output timing calculated at the current detection point just before the next detection point. Then, it is determined whether or not outputting of a music performance signal is in time for the preceding output timing calculated at the current detection point, in a case of waiting for the passing through the next detection point. While it is determined that outputting of a music performance signal is in time for the preceding output timing calculated at the current detection point, deciding of the preceding output timing is suspended. When the current detection point is just before a detection point at which outputting of a music performance signal is not in time for the preceding output timing calculated at the current detection point, the music performance signal is outputted at the preceding output timing calculated at the current detection point.

According to this embodiment, in addition to the effects of the first embodiment, a string striking timing can be estimated more accurately as movement of the operator can be detected at a time point closer to the string striking timing (normal output timing). Further, as the preceding output timing is calculated based on the string striking timing thus estimated, a music performance signal can be outputted at the more accurate preceding output timing.

The performance information output control apparatus may be configured to include the estimated music-sound generation time analysis part 30, the setting acceptance part 40, the music performance information output part 50, the timer 60 and the memory 70. The performance information output control apparatus may be used in combination with the keyboard instrument 100.

The constituent elements in each of the aforesaid embodiments may be selectively and suitably replaced by known constituent elements within a range not departing from the gist of the present invention. The technical range of the present invention is not limited to the aforesaid embodiments, but each of the embodiments may be changed in various manners within a range not departing from the gist of the present invention. For example, the detection method of movement of the hammer 2 explained above is a mere example. As another embodiment, the number of the optical sensor may be only one, and a string striking speed of the hammer 2 and a string striking timing may be calculated according to a light quantity detected by the optical sensor which changes when the shutter 16 interrupts light emitted from the light source to the optical sensor. Further, as a still another embodiment, a string striking speed of the hammer 2 and a string striking timing may be calculated using a gray scale as disclosed in JP-A-2003-5754. The keyboard instrument 100 is not limited to a piano. The present invention may be applied to an electronic piano which is configured to output music performance information at the aforesaid normal output timing.

What is claimed is:

1. A performance information output control apparatus comprising:

a detection part that detects a plurality of positions of a music performance interface during a single stroke with respect to an operator of a keyboard instrument, the music performance interface including a mechanism that interlocks with the operator of the keyboard instrument;

an estimated music-sound generation time analysis part that:

calculates an estimated music-sound generation time point representing a time point at which music sound according to the single stroke with respect to the operator is estimated to be generated, based on a detection result of the positions of the music performance interface by the detection part; and determines an output timing at which music performance information representing music performance contents corresponding to the single stroke with respect to the operator is output by dynamically changing a time period by a detection by the detection part to an output of the music performance information according to a speed of the mechanism that interlocks with the operator obtained from the detection result from the detection part; and a music performance information output part that outputs the music performance information at the output timing determined by the estimated music-sound generation time analysis part prior to the calculated estimated music-sound generation time point.

2. The performance information output control apparatus according to claim 1, wherein the music performance information output part outputs, based on an output preceding time period determined according to a time period until music sound according to the single stroke with respect to the operator is generated, the music performance information when a current time point reaches a preceding output time point that is earlier than the estimated music-sound generation time point by the output preceding time period.

3. The performance information output control apparatus according to claim 2, wherein:

the estimated music-sound generation time analysis part obtains detection results corresponding to the plurality of positions of the music performance interface detected during the single stroke with respect to the operator, and calculates, based on each of the respective detection results thus obtained, a next detection time point at which next detection result is obtained after the time point where the each detection result is obtained and also calculates the estimated music-sound generation time point, and the music performance information output part outputs the music performance information when a current time point reaches the preceding output time point, in a case where the preceding output time point determined based on the estimated music-sound generation time point is prior to the next detection time point.

4. The performance information output control apparatus according to claim 1, wherein the estimated music-sound generation time analysis part sets the time period, from the detection by the detection part to the output of the music performance information, to be shorter as the speed of the mechanism that interlocks with the operator becomes faster.

5. A keyboard instrument comprising:

a plurality of operators; and a performance information output control apparatus that comprises:

a detection part that detects a plurality of positions of a music performance interface during a single stroke with respect to an operator of a keyboard instrument, the music performance interface including a mechanism that interlocks with the operator of the keyboard instrument;

an estimated music-sound generation time analysis part that:

calculates an estimated music-sound generation time point representing a time point at which music sound according to the single stroke with respect to the operator is estimated to be generated, based on a detection result of the positions of the music performance interface by the detection part; and determines an output timing at which music performance information representing music performance contents corresponding to the single stroke with respect to the operator is output by dynamically changing a time period by a detection by the detection part to an output of the music performance information according to a speed of the mechanism that interlocks with the operator obtained from the detection result from the detection part; and a music performance information output part that outputs the music performance information at the output timing determined by the estimated music-sound generation time analysis part prior to the calculated estimated music-sound generation time point.

6. The keyboard instrument according to claim 5, wherein the estimated music-sound generation time analysis part sets the time period, from the detection by the detection part to the output of the music performance information, to be shorter as the speed of the mechanism that interlocks with the operator becomes faster.

7. A method of controlling a performance information output control apparatus, the method comprising the steps of:

detecting a plurality of positions of a music performance interface during a single stroke with respect to an operator of a keyboard instrument, the music performance interface including a mechanism that interlocks with the operator of the keyboard instrument;

calculating an estimated music-sound generation time point representing a time point at which music sound according to the single stroke with respect to the operator is estimated to be generated, based on a detection result of the positions of the music performance interface;

determining an output timing at which music performance information representing music performance contents corresponding to the single stroke with respect to the operator is output by dynamically changing a time period from a detection of the music performance interface to an output of the music performance information according to a speed of the mechanism that interlocks with the operator obtained from the detection result of the positions of the music performance interface; and outputting the music performance information at the determined output timing prior to the calculated estimated music-sound generation time point.

8. The method according to claim 7, wherein the time period from the detection of the music performance interface to the output of the music performance information is set to be shorter as the speed of the mechanism that interlocks with the operator becomes faster.

* * * * *